US007614519B2

(12) United States Patent
Krauth et al.

(10) Patent No.: US 7,614,519 B2
(45) Date of Patent: Nov. 10, 2009

(54) PUSH BUTTON DISPENSING LID

(75) Inventors: Marlene N. Krauth, Rogers, AR (US); Peter Piscopo, Medford, NJ (US); Richard Seager, Mystic, CT (US)

(73) Assignee: Rockline Industries, Inc., Sheboygan, WI (US)

( * ) Notice: Subject to any disclaimer, the term of this patent is extended or adjusted under 35 U.S.C. 154(b) by 191 days.

(21) Appl. No.: 11/565,114

(22) Filed: Nov. 30, 2006

(65) Prior Publication Data

US 2008/0128451 A1 Jun. 5, 2008

(51) Int. Cl.
*B65D 43/26* (2006.01)

(52) U.S. Cl. ..... 220/264; 220/262; 220/263; 220/835

(58) Field of Classification Search ..... 220/263, 220/262, 264, 283, 784, 788, 835, 840
See application file for complete search history.

(56) References Cited

U.S. PATENT DOCUMENTS 4,185,754 A * 1/1980 Julius ..... 221/63
4,863,064 A * 9/1989 Dailey, III ..... 221/48
4,917,253 A 4/1990 Dutt
5,040,680 A * 8/1991 Wilson et al. ..... 206/459.5
5,582,294 A * 12/1996 Yamada ..... 206/494
5,699,912 A * 12/1997 Ishikawa et al. ..... 206/494
5,868,265 A 2/1999 Kobayashi
6,065,626 A * 5/2000 Huang et al. ..... 220/254.5
6,206,221 B1 * 3/2001 Bando et al. ..... 220/254.5
6,269,970 B1 8/2001 Huang et al.
6,305,563 B1 10/2001 Elliott
6,394,298 B1 * 5/2002 Zaidman ..... 220/259.1
6,460,712 B2 10/2002 Smith et al.
6,520,331 B2 2/2003 Okin et al.
6,655,544 B1 * 12/2003 Tanaka et al. ..... 220/835
6,729,498 B2 * 5/2004 Yelton et al. ..... 221/63
6,758,366 B2 * 7/2004 Bourgund et al. ..... 220/836
6,902,077 B1 6/2005 Tack et al.
6,942,118 B2 9/2005 Zethoff et al.
6,951,292 B2 10/2005 Bando et al.
7,000,792 B2 2/2006 Arai
7,004,349 B2 * 2/2006 Heiberg et al. ..... 220/827
7,021,483 B2 4/2006 Tack et al.
7,128,227 B2 10/2006 Skillin et al.
7,228,984 B2 * 6/2007 Tack et al. ..... 220/259.1

(Continued)

*Primary Examiner*—Anthony Stashick
*Assistant Examiner*—Christopher McKinley
(74) *Attorney, Agent, or Firm*—Reinhart Boerner Van Deuren s.c.

(57) ABSTRACT

A sealing push-button lid for consumer wipes is disclosed. The lid may be used to seal a package of wipes for infant care, and may also be used for sealing and dispensing of one-at-a-time wipes for general cleaning purposes. The lid makes it easy for a busy person to use a single hand to pop open the lid in order to grasp and dispense the next wipe in a series of Z-folded wipes or inner-folded wipes in a preferably soft and flexible container. Containers with the push button lid may also be used with wipes that are folded in other ways. The lid is formed as one piece or two pieces, the pieces joined by a hinge that allows movement of the lid top with respect to the lid bottom. The lid is designed for easy joining and sealing to a container, preferably by a bead of hot melt adhesive or adhesive strips.

22 Claims, 4 Drawing Sheets

U.S. PATENT DOCUMENTS

2002/0017522 A1* 2/2002 Bando et al. ..... 220/254
2004/0007113 A1 1/2004 Morrisey-Hawkins
2005/0045636 A1 3/2005 Lown et al.
2005/0092764 A1 5/2005 Chasid et al.
2005/0145642 A1 7/2005 Morrisey-Hawkins
2006/0096984 A1* 5/2006 Bandoh et al. ..... 220/254.5
2006/0118557 A1 6/2006 Tack et al.
2006/0191933 A1 8/2006 Hicks et al.

* cited by examiner

PUSH BUTTON DISPENSING LID

FIELD OF THE INVENTION

This invention generally relates to sealing lids for dispensing of one-at-a-time wipes for consumer healthcare, infant care, cleaning and wiping products.

BACKGROUND OF THE INVENTION

Busy families on the go prefer to take their children on family expeditions of all types, whether traveling to relatives, other parts of their country, or even foreign countries. When traveling with children, it is highly convenient to include wetted disposable tissues or wipes for cleaning and sanitation purposes. These wipes may include baby wipes, kitchen wipes, or general-purpose cleaning wipes. Packages of such wipes should be small and convenient for packing and travel. In addition, packs of the wipes should be flexible and able to fit into a small space within a travel bag or suitcase. Thus, a flexible container in a soft-pack is preferable to a larger pack with a hard plastic cylinder or rounded rectangular tub. These large, hard packages will not fit conveniently into consumers' travel plans or for consumers with limited space available.

Of course, it goes without saying that the package of wipes, once opened, should be able to retain its moisture, and thus its cleaning ability, as well as the lotions, scents, or other products that are incorporated into the wetted wipes. A large package with 200-300 wipes can more easily bear the cost of a reliable and expensive closure that includes a good moisture seal. A small flexible package of wipes will only be practical if the opening or seal of the package is both inexpensive and effective. The prior art shows many attempts at such seals. For example, U.S. Pat. No. 6,206,221 discloses a covering plate with a hinged lid for applying to a large container of wetted tissues or wipes. The cover includes a top plate and a hinged lid, and the cover extends to enclose a top of an entire container of wipes. This product is complicated, and will be too expensive and heavy for the use that is desired. U.S. Pat. No. 6,394,298 is similar to the '221 patent, in that the dispensing cover disclosed is designed to fit over an entire, large container. This cover will also be heavy and inconvenient.

U.S. Pat. No. 6,655,544 may be even further from the mark, disclosing an entire container with a lid. The container and lid include a fairly complicated sealing and locking mechanism. Products made in accordance with this disclosure will seal well, but will not be flexible or convenient for travel and quick access to the wetted wipes. U.S. Pat. No. 6,729,498 has a similar disclosure, with a dispenser having a container and a lid. This dispenser will also be relatively expensive and rigid, as opposed to the desired flexible and inexpensive lids sought by consumers. U.S. Pat. Nos. 6,902,077 and 7,021,483 are similar, disclosing a rigid, heavy container for wetted wipes. These patents include a complicated hinging mechanism, and include ribs for additional stability and rigidity, rather than the desired flexibility.

U.S. Pat. No. 7,004,349 discloses another relatively rigid container and lid with an elastomeric spring to help pop open the lid when a user depresses a latch. U.S. Pat. No. 6,942,118 teaches a closure for a container, rather than an entire container and closure, per the discussions above. However, while wetted wipes or cloths are discussed, there is no provision for a seal between the closure and the container to which it will be fitted, except for a tight fit between the two. This may be achieved by using dimensions with tight tolerances for fitting the closure onto the container. The closure will thus be both relatively expensive and relatively rigid.

As noted above, the prior art discloses rigid containers and relatively rigid and complicated seals for those containers, but does not teach a cover only, the cover relatively flexible and sufficiently simple to be cost effective in today's competitive, cost-conscious markets. The present invention provides such a simple, flexible, and easy-to-open cover. These and other advantages, as well as additional inventive features, will be apparent from the description of the embodiments provided herein.

BRIEF SUMMARY OF THE INVENTION

One embodiment is a plastic container lid. The lid includes a plastic lid bottom, the bottom having a sealing portion and a latching and releasing portion adjacent the sealing portion, the latching and releasing portion flexibly joined to the sealing portion, and the lid bottom having an open central dispensing area. The lid also includes a plastic solid lid top further having a catch for mating with the latching portion, the lid top hingedly and flexibly connected to the bottom portion.

Another aspect is a plastic container lid. The lid includes a plastic lid bottom, the bottom having a sealing portion and a latching and releasing portion adjacent the sealing portion, the latching and releasing portion flexibly joined to the sealing portion, and the lid bottom having an open central dispensing area. The lid also includes a plastic solid lid top further having a catch for mating with the latching portion, the lid top hingedly and flexibly connected to the bottom portion, and a spring between the lid top and bottom, the spring urging apart said lid top and bottom.

Other aspects of the invention will become more apparent from the following detailed description when taken in conjunction with the accompanying drawings.

BRIEF DESCRIPTION OF THE DRAWINGS

The accompanying drawings incorporated in and forming a part of the specification illustrate several embodiments of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PRESENTLY PREFERRED EMBODIMENTS

There are many embodiments of the push button dispensing lid. The embodiments are desirably used in combination with a soft-pack of wetted wipes, wetted tissues, wet cleaning cloths, or other wetted disposables. The push button dispensing lid has been designed to fit onto a top surface of a flexible soft-pack of wipes. The lid allows the user to open the underlying pack while providing a closure and seal to keep the moist towels or cleansing cloths within the pack moist and hydrated, without undesirable loss of moisture. The pack or container is desirably small, to fit into a handbag or travel bag for convenience on the move. Such packs are typically made from one or more layers of plastic film, such as polyethylene film, polypropylene film, polyester or Tyvek film, and the like. The lid will also work well when used with more traditional, harder containers, such as stiff cylindrical or roughly-rectangular or roughly-square plastic or fiber-board containers. Embodiments may include a convenient quantity of Z-folded wipes or inner-folded wipes in a preferably soft and flexible container. Containers with the push button lid may also be used with wipes that are folded in other ways.

Figure 1:
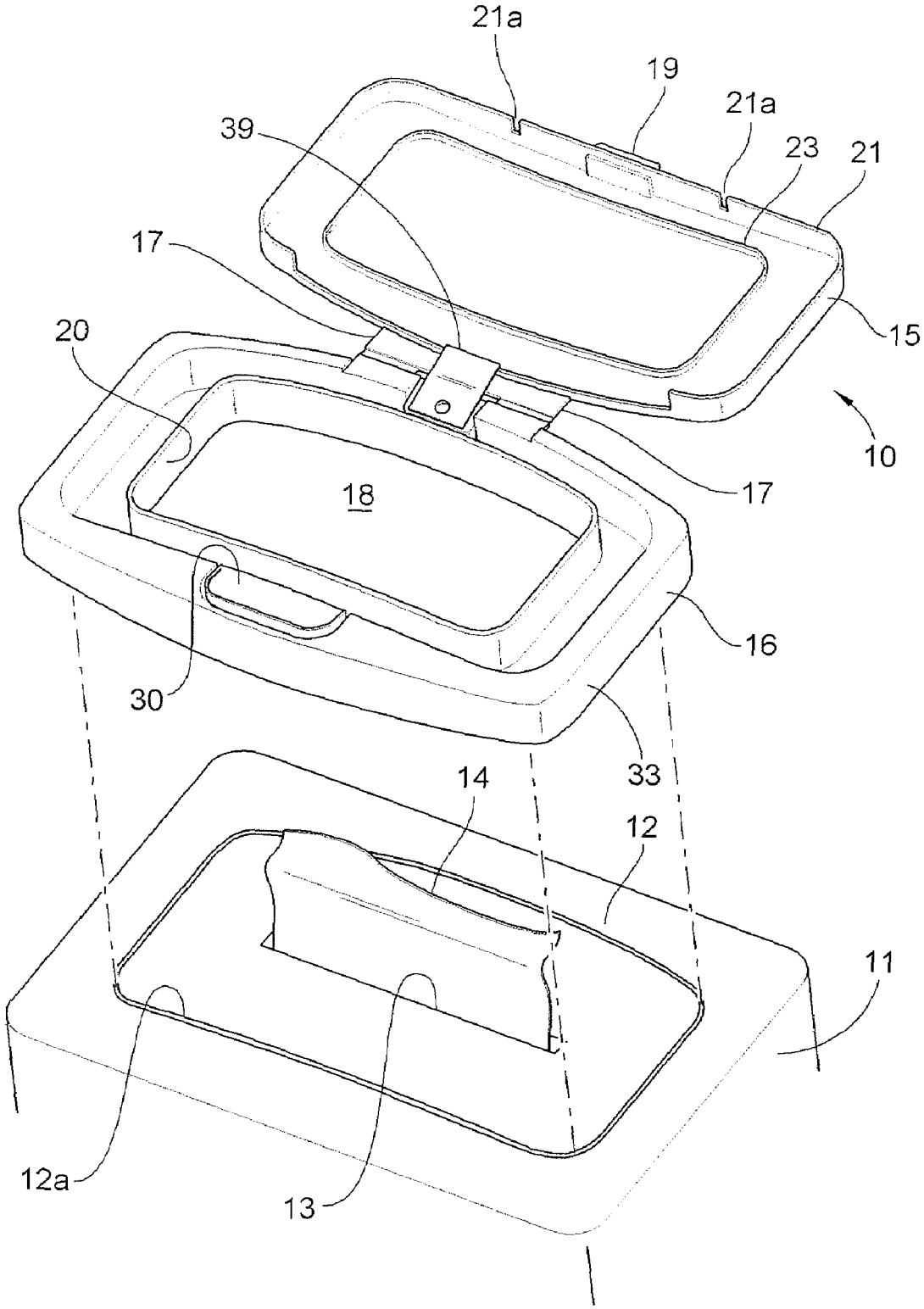
FIG. 1 is a perspective view of a first embodiment of a push button dispensing lid.

One embodiment of a push button dispensing lid in an open position is disclosed in FIG. 1. A push button dispensing lid 10 fits atop a tissue soft pack 11. The soft pack 11 typically is made from one or more layers of thin film and includes an area 12 on top with an opening 13 for dispensing tissues or towelettes 14. Push button dispensing lid 10 is intended to fit only around a portion of the top, such as area 12, rather than fitting around the edges of the entire top surface of soft pack 11. The push button dispensing lid includes a lid top 15, a lid bottom 16, and a hinge 17 connecting the top and bottom. The lid bottom includes a central void area 18, which will allow a user to dispense consumables from the pack when lid 10 is opened. Lid top 15 includes a catch 19 to catch on an underside of push button 30 and hold lid top 15 in a closed position. Lid top 15 also includes an outer vertical wall 21 transverse to the major surface of the lid top, and a second, inner vertical wall 23. Walls 21 and 23 may form sealing surfaces with lid bottom 16 when the push button dispensing lid is closed. The bottom sealing surface will be mated to a top surface of a pack of wipes with a bead of hot melt glue 12*a* on either the lid bottom or the pack top surface. Other forms of adhesive, such as strips of adhesive, may also be used.

Lid bottom 16 includes an outer transverse vertical wall 33 as shown and an inner transverse vertical wall 20. Lid top inner vertical wall 23 preferably fits within and seals with inner transverse vertical wall 20 of the lid bottom. This seal is the principal seal between the lid top and bottom members. The space within the sealed area also allows room for the tail of the next wipe or towellette, so that it is ready for dispensing. The outer walls, 21, 33 of the lid top and bottom may also form a seal, but this seal is secondary to the principal seal. The lid top and bottom are urged apart by a spring 39 that is placed near the hinge 17. In this embodiment, spring 39 is a leaf spring, formed by a rectangle of plastic and secured by its near end to one of the lid top and bottom. The far end of the leaf spring may bear against the other of the lid top and bottom, to urge apart the lid top and bottom when the user pushes the push button 30 to open the lid.

Figure 2:
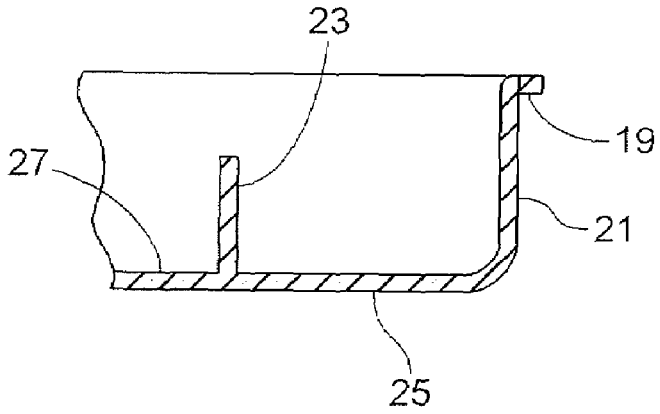
FIGS. 2-4 are partial cross-section views of the embodiment of FIG. 1.
Figure 3:
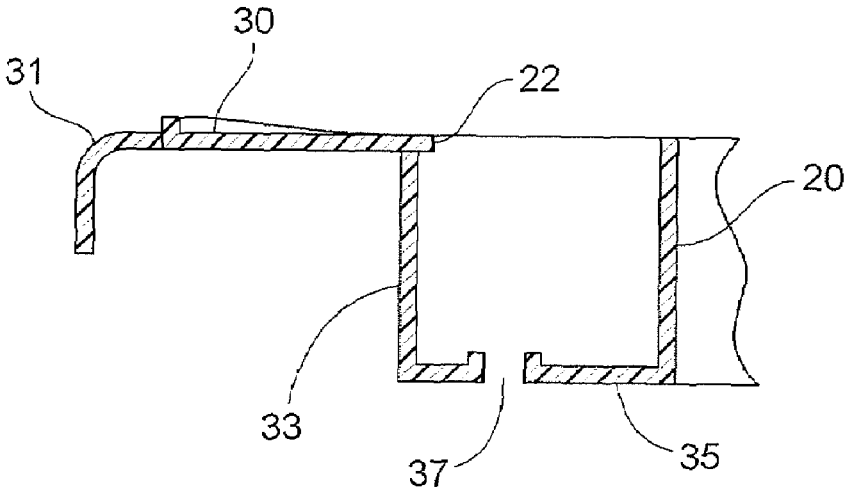
Figure 4:
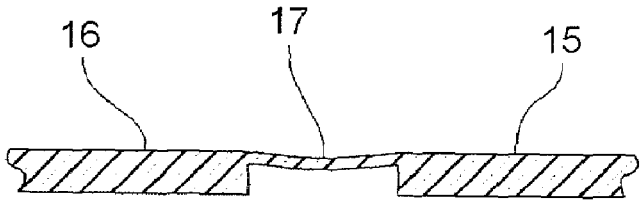

FIGS. 2-4 show details of this embodiment of the push button dispensing lid. FIG. 2 depicts a cross-section of the lid top in an open position, as the top appears in FIG. 1. The lid top includes the catch 19, outer transverse vertical wall 21, outer portion 25 of the lid top, inner vertical wall 23, and a central closed area 27 of the lid top. The catch protrudes only a short distance, preferably about 0.040 to 0.060 inches, about 1 mm. FIG. 3 depicts a cross-section of the lid bottom, including inner transverse wall 20, lid bottom sealing area 35, optional relief 37, outer transverse wall 33, push button 30 and push button back side 31. The push button includes a latch 22 that protrudes slightly downwardly and transversely to outer wall 33. Latch 22 preferably extends about the same as catch 19, about 040 to 0.060 inches, about 1 mm. Other dimensions may also be used. Both the catch and the latch are from about one-quarter inch (about 6 mm) to about one-half inch (about 13 mm) wide, preferably about three-eighths of an inch (about 10 mm) wide. FIG. 4 depicts the hinges 17 that connect lid top 15 to lid bottom 16. The hinges are preferably about one-quarter inch (about 6 mm) wide, and are about 0.040 inches (about 1 mm) thick. There are preferably two or three spaced-apart hinges between the lid top and bottom, although only one hinge may be used instead.

Figure 4A:
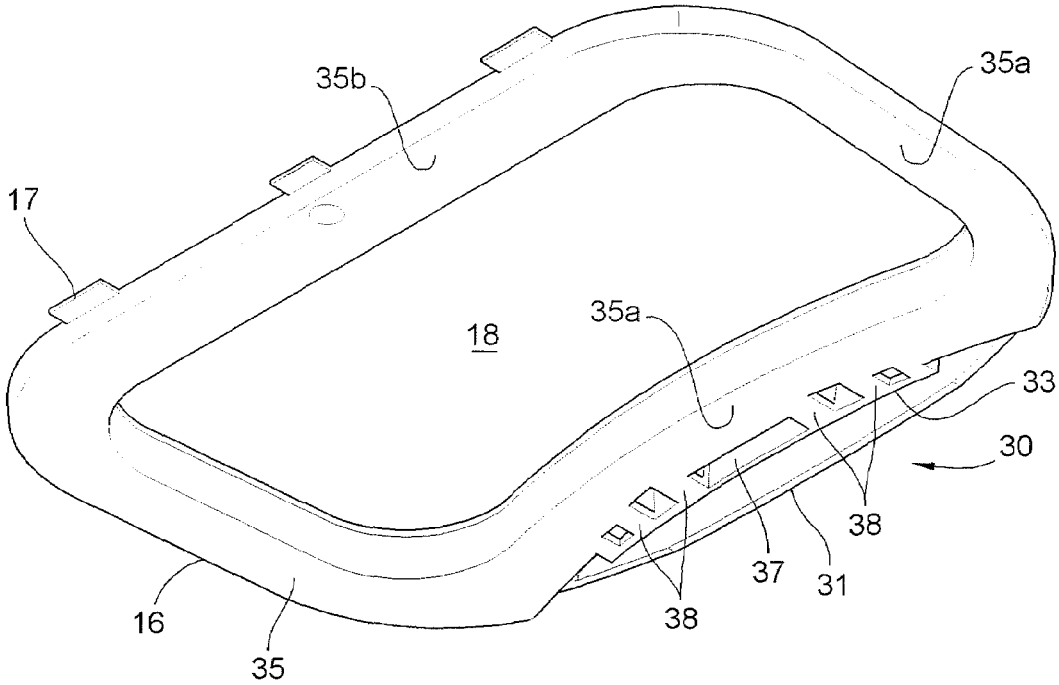
FIG. 4*a* is a perspective view from the bottom of the push button dispensing lid bottom of FIG. 1.

The push button dispensing lid has a seal, discussed above, between the lid top and lid bottom. This seals the container of which the lid is a part after the container is opened and the push button dispensing lid is applied to the package. There is also a seal between the lid bottom and the package or container to which the lid is applied. The seal is preferably made between the bottom surface 35 of the lid bottom 16. FIG. 4*a* depicts a closer view of a preferred embodiment of the lid bottom, as viewed from its bottom side. Lid bottom 16 includes hinges 17 for connecting with a lid top (not shown in this view), and also includes an open area 18 for dispensing. The bottom surface 35 is flat and preferably includes a narrower portion 35*a* nearer the push button feature and push button back side 31, and a wider portion 35*b* on the opposite side, near the hinges. As can be seen from this bottom view, push button 30 is connected to lid bottom 16 via ribs 38 with an reliefs or spaces 37 between the ribs. Without being bound to any particular theory, it is believed that the combination of ribs and spaces allows the user to deflect the push button structure without deflecting the bottom surface 35 sufficiently to disturb or break the seal between the lid bottom and the container to which the lid bottom is attached.

Figure 5:
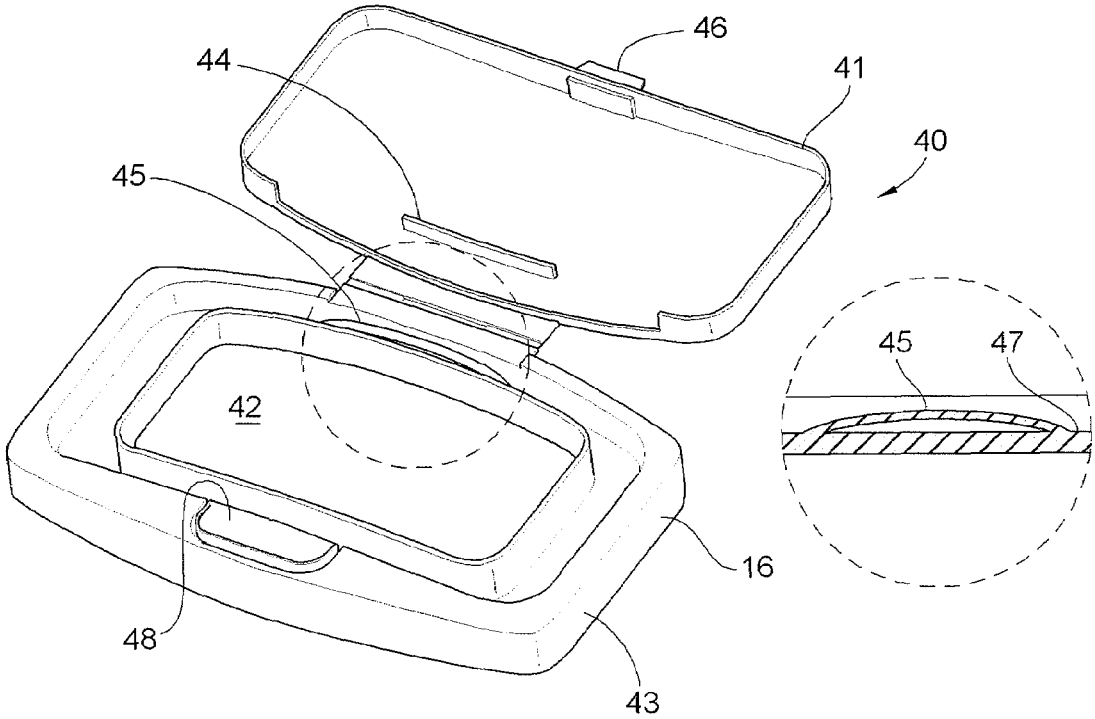
FIG. 5 is a second embodiment of a push button dispensing lid.

There are a number of additional embodiments of a push button dispensing lid. As noted, a spring may be placed between the top and bottom of the lid to urge them apart. There are embodiments besides a separate plastic leaf spring placed transversely between the lid top and bottom as shown above. For example, as shown in the container lid 40 of FIG. 5, the spring 45 may be molded directly into the lid bottom 43. Spring 45 is simply a part of the lid bottom that is raised a short distance so that it meets an actuator 44 that is molded directly into lid top 41. Lid bottom 43 also includes central open area 42. Lid top 41 also includes a catch 46 for holding lid top 41 closed by a latch (not shown) on the underside of push button 48. As shown in the detailed view, spring 45 is simply a small portion of plastic that is raised above the bottom lid inner surface 47.

Figure 6:
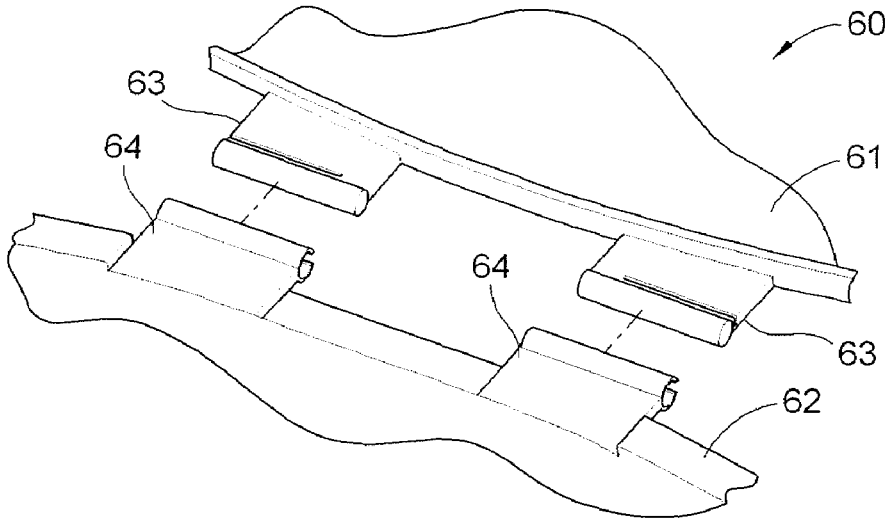
FIG. 6 is an alternate hinge for a push button dispensing lid.

Another embodiment is a lid that is made from two portions, a lid top and a lid bottom that are molded separately. As shown in FIG. 6, lid 60 includes a lid top 61 that has been molded with two hinge leaves 63. Lid bottom 62 has been molded separately with two hinge pivots 64. The hinge leaves 63 fit into the pivots 64, so that the lid top and bottom form hinges from the hinge leaves and pivots. Leaves 63 preferably fit snugly into the pivots 64, so that the leaves are positively retained. In this embodiment, a spring is preferred, but is not shown for clarity in the figure.

Figure 7:
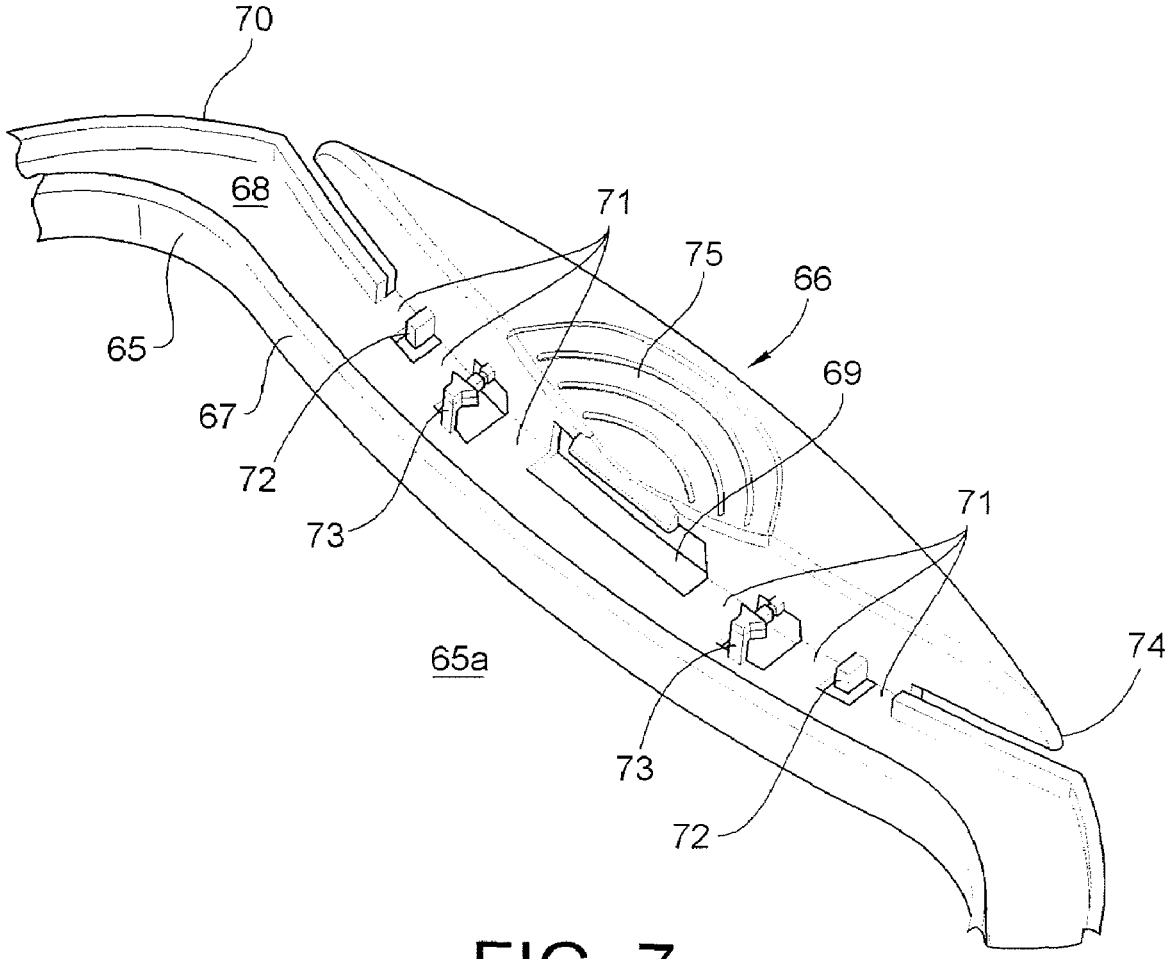
FIG. 7 is a perspective view of an alternate embodiment of the push button dispensing lid.

One particular embodiment of our push button lid has been found to work very well with soft-pack tissue packs. This embodiment is depicted in FIG. 7, and focuses on the interface between the lid bottom 65 and the push button 66. Lid bottom 65 includes the central open or dispensing area 65*a*, inner transverse vertical wall 67 and outer transverse vertical wall 70. Wall 67 is preferably taller than wall 70, for example, about one-quarter inch, or 6-7, mm high, while wall 70 is about one-eighth inch high, or about 3 mm high, or a little less. Shown in FIG. 7 is the top side 68 of lid bottom 65. This surface is preferably flat, top side and bottom side, for forming a seal with the tissue pack or container to which the bottom is affixed. Push button 66 includes a gripping area 75 for a thumb or finger of a user.

Push button 66 is in the form of an upside-down canoe, i.e. the push button is hollow, with the top surface closed and the under side open. Outer transverse vertical wall 70 extends only a short way into the area between push button 66 and lid bottom 65. The wall gives way to six flat ribs 71, three on each side of a large relief 69. The push button 66 also includes four thin guides or ribs 72, 73, protruding from the inner surface of the push button. The inner two ribs 73 extend to and join with bottom surface 68. It is preferable that these inner ribs fit into reliefs molded into the matching surface of the lid top, as shown in FIG. 1. The combination of ribs and reliefs help to guide the lid top and bottom to a closed position when the user so desires.

Embodiments are preferably made by injection molding the lids in a single shot using a polypropylene resin, to take advantage of the inherent "living hinge" that is possible with polypropylene. The spring may be molded in as shown in embodiments above, or may be added via a secondary operation, e.g., trapping or adhering a spring to the inside of the lid, as also shown above. Lid embodiments according to the present invention may also be made with other preferably flexible resins, such as polyethylene, low density polyethylene, or linear low density polyethylene. Henceforth, the term polyethylene is intended to include standard polyethylene, low density polyethylene, and linear low density polyethylene. Other resins may include polycarbonate, acrylonitrile-butadiene-styrene (ABS), acetal, and nylon. While injection molding is a preferred low-cost, high volume method of production, the lids may also be made by thermoforming, or any other suitable method of production. Injection molding is preferred.

The flat area on the bottom surface of the lid bottom is designed to have an enlarged surface area, so that adhesive applied to the flat area will have an excellent grip to the package to which the lid is applied. In production situations, automated machinery may be used to apply a full or partial bead of adhesive, such as a hot melt adhesive, to the flat area. Other automated systems, such as automated cutting machinery to apply a film of double-sided pressure sensitive adhesive may also be used. An adhesive could even be applied manually, but this would not be as efficient as an automated system. Embodiments preferably use an adhesive that is effective to create a seal between lid and container that retains moisture and keeps the wipes or towelettes fresh. Without limiting the embodiments, flexible packs with the push button dispensing lid preferably contain from about 60-85 wipes or towelettes in a flexible package. Other quantities may be used.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A plastic container lid, comprising:

a plastic lid bottom, comprising a sealing portion and a latching and releasing portion adjacent the sealing portion, the latching and releasing portion flexibly joined to the sealing portion, and the lid bottom having an open central dispensing area, wherein the releasing portion comprises:

a plurality of guides, each of which extends outwardly from the releasing portion toward the sealing portion and upwardly from the sealing portion, and each of which is coupled to the sealing portion; and a plastic solid lid top further comprising a catch for mating with the latching portion, the lid top hingedly and flexibly connected to the bottom portion;

wherein the guides direct the lid top into releasable interaction with the lid bottom and limit the downward motion of the lid top as the plastic container lid transitions from an open configuration to a closed configuration; and wherein the flexible pivoting of the releasing portion causes the guides attached to the releasing portion to move in an upward direction towards the container lid and urge the container lid away from the container bottom, thereby initiating movement of the plastic container lid from a closed configuration to an open configuration.

2. The plastic container lid according to claim 1, wherein the lid top and bottom comprise mating seals forming at least one seal around the central dispensing area.

3. The plastic container lid according to claim 1, wherein the lid top and bottom comprise mating seals forming at least one seal around the central dispensing area, the seals comprising surfaces raised transverse to flat areas of the lid top and bottom.

4. The plastic container lid according to claim 1, wherein a raised sealing surface of the top portion fits within a raised sealing surface of the bottom area when the lid is closed.

5. The plastic container lid according to claim 1, further comprising a spring between the lid top and bottom, the spring urging apart said lid top and bottom.

6. The plastic container lid according to claim 1, wherein the catch protrudes horizontally from a vertical surface of the lid top and the latching portion protrudes horizontally from a vertical surface of the latching and releasing portion.

7. The plastic container lid according to claim 1, wherein the releasing portion further comprises a gripping portion for a thumb or a finger of a user.

8. The plastic container lid according to claim 1, wherein the lid top and bottom are formed by molding as a single piece with at least one hinge leaf connecting the lid top and bottom.

9. The plastic container lid according to claim 1, wherein the lid top and bottom are formed by molding as two separate pieces and are joined by connecting at least one hinge leaf on one of the lid top and bottom with at least one pivot on the other of the lid top and bottom.

10. The plastic container lid according to claim 1, wherein the container lid is formed by injection molding as a single piece.

11. A plastic container lid, comprising:

a plastic lid bottom, comprising a sealing portion and a latching and releasing portion adjacent the sealing portion, the latching and releasing portion flexibly joined to the sealing portion, and the lid bottom having an open central dispensing area, wherein the releasing portion comprises:

a plurality of guides, each of which extends outwardly from the releasing portion toward the sealing portion and upwardly from the sealing portion, and each of which is coupled to the sealing portion;

a plastic solid lid top further comprising a catch for mating with the latching portion, the lid top hingedly and flexibly connected to the bottom portion; and a spring between the lid top and bottom, the spring urging apart said lid top and bottom wherein the guides direct the lid top into releasable interaction with the lid bottom and limit the downward motion of the lid top as the plastic container lid transitions from an open configuration to a closed configuration; and wherein the flexible pivoting of the releasing portion causes the guides attached to the releasing portion to move in an upward direction towards the container lid and urge the container lid away from the container bottom, thereby initiating movement of the plastic container lid from a closed configuration to an open configuration.

12. The plastic container lid according to claim 11, wherein the container lid is formed by injection molding of polypropylene as a single piece.

13. The plastic container lid according to claim 11, further comprising reliefs on at least one of the lid bottom and lid top, said reliefs in the area of the catch of the lid top and the catching and releasing portion of the lid bottom.

14. The plastic container lid according to claim 11, wherein the sealing portion comprises a flat area periphery at least about one-quarter inch (about 6 mm) wide.

15. The plastic container lid according to claim 11, wherein the sealing portion comprises a rounded, generally rectangular shape and having a planar periphery at least about one-quarter inch (about 6 mm) wide on one side.

16. The plastic container lid according to claim 11, wherein the sealing portion comprises a rounded, generally rectangular shape and having a planar periphery at least about one-quarter inch (about 6 mm) wide, and wherein at least one side of the planar periphery is about 10 mm wide.

17. The plastic container lid according to claim 11, wherein the latching and releasing portion is joined to the sealing portion in a bottom plane of the sealing portion.

18. The plastic container lid according to claim 11, wherein the plastic container lid comprises a material selected from the group consisting of polypropylene, polyethylene, low density polyethylene, linear low density polyethylene, polycarbonate, acetal, nylon, and acrylonitrile-butadiene-styrene (ABS).

19. The plastic container lid according to claim 11, further comprising a container with or without wipes joined to said lid, and optionally an adhesive joining the lid to the container.

20. The plastic container lid according to claim 11, wherein one of the lid top and lid bottom comprises one of ribs or reliefs for fitting into the other of ribs or reliefs in the other of the lid top and lid bottom.

21. The plastic container lid of claim 1, wherein the releasing portion flexibly pivots downwardly and outwardly with respect to the sealing portion to disengage from the catch and allow the plastic container lid to move from a closed configuration to an open configuration.

22. The plastic container lid of claim 11, wherein the releasing portion flexibly pivots downwardly and outwardly with respect to the sealing portion to disengage from the catch and allow the plastic container lid to move from a closed configuration to an open configuration.

* * * * *